US006122437A

United States Patent [19]

Johnson

[11] Patent Number: 6,122,437

[45] **Date of Patent: *Sep. 19, 2000**

[54] ELECTRIC SPACE HEATER WITH SWIVEL MOUNT

[75] Inventor: James B. Johnson, Urbana, Ohio

[73] Assignee: The W. B. Marvin Manufacturing Company, Urbana, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/857,436

[22] Filed: May 16, 1997

[51] Int. Cl.[7] ..... F24C 1/14

[52] U.S. Cl. ..... 392/376; 392/360; 392/364; 392/368

[58] Field of Search ..... 392/376, 364, 392/360, 368, 436, 437, 412, 413, 430; 362/403, 408, 409, 412, 418; 348/143, 150; 219/762

[56] References Cited

U.S. PATENT DOCUMENTS

| | | | |
|---|---|---|---|
| D. 379,650 | 6/1997 | Smith et al. | D23/335 |
| 1,154,412 | 9/1915 | Shailor . | |
| 2,495,513 | 1/1950 | Doyle | 201/63 |
| 3,087,118 | 4/1963 | Goffstein | 325/312 |
| 4,410,933 | 10/1983 | Blake et al. | 362/371 |
| 5,621,846 | 4/1997 | Smith et al. | 392/376 |

FOREIGN PATENT DOCUMENTS 75675 1/1959 Norway .

421 405 3/1967 Switzerland .

OTHER PUBLICATIONS

Advertisement for quartz modular heaters, published by Tansun—Quartz Heat Division, Tunnel Road, Hill Top, West Bromwich, West Midlands, B70 ORD, at least as early as Sep. 10, 1993.

See accompanying Information disclosure Statement regarding admitted prior art.

Marvin 7000 Workshop Heater Instruction Manual, front cover 3rd and 4th pages and back cover, published 1995 by W. B. Marvin Manufacturing Company, Urbana, Ohio.

*Primary Examiner*—Teresa Walberg
*Assistant Examiner*—Vinod Patel
*Attorney, Agent, or Firm*—Roger S. Dybvig

[57] ABSTRACT

An electric heater has a housing defining a heat-transmitting window and reflector assembly is mounted in housing that has a heat reflective surface. A heating element extends within the reflector assembly between opposite ends of the housing and radiates heat energy which is reflected by the reflector assembly. A pair of bracket arms are rotatably attached to opposite ends of the housing for securing the heater to a ceiling. A control switch mounted within one of the bracket arms and a control knob secured to the switch are substantially centered on the heater's axis of rotation. A U-shaped support assembly is used to mount the heater to the ceiling so that the heater is detachably connected to the support assembly. The support bracket can be mounted to the ceiling by a single wood bolt extending through an aperture provided centrally in the support assembly. As a result, the heater can be swiveled about the bolt.

13 Claims, 2 Drawing Sheets

ELECTRIC SPACE HEATER WITH SWIVEL MOUNT

INCORPORATION BY REFERENCE

The entire disclosure of Smith et al. U.S. Pat. No. 5,621,846 granted Apr. 15, 1997, is hereby incorporated by reference herein.

FIELD OF THE INVENTION

This invention relates to electric space heaters and, more particularly, to swivel mounted, ceiling mounted electric workshop heaters.

BACKGROUND OF THE INVENTION

Heaters for use in workshop areas are well known in the art. For example, U.S. Pat. No. 5,621,846 discloses a ceiling-mounted workshop heater that is pivotably mounted about a horizontal axis to direct heat energy therefrom to a desired area of the workshop. However, known heaters are adjustable only by pivotal movement about a horizontal axis, which limits the areas of the workshop to which heat energy can be directed. Therefore, the need exists for a mounting arrangement in which heat energy from a ceiling-mounted heater can be directed in any direction to thereby heat any desired area of a workshop.

SUMMARY OF THE INVENTION

An object of this invention is to provide a ceiling-mounted electric heater that is adjustable to direct heat energy from the heater to any area of a surrounding workspace.

Another object of this invention is to provide a ceiling-mounted electric heater that can be swiveled about a vertical axis to direct heat energy from the heater to a desired area of the surrounding workspace. A related object is provide a heater that can be swiveled about a vertical axis and that is also pivotal about a horizontal axis.

Still another object of this invention is to provide a swivel mounting arrangement for a ceiling-mounted heater that is inexpensive and easily installed.

In accordance with this invention, a ceiling-mounted heater as disclosed in above-mentioned U.S. Pat. No. 5,621,846 comprises a housing having mounted therein a heating element. The housing is connected to mutually-spaced support arms of a U-shaped support bracket, and the support arms are joined by and depend downwardly from a horizontally-extending support member. A wood bolt or other suitable fastener extends through an aperture in the support member intermediate the support arms and into a joist in the ceiling. As a result, the heater can be swiveled about a vertical axis defined by the wood bolt to direct heat energy from the heater to any desired area of the surrounding workspace. The heater housing is preferably pivotal about a horizontal axis relative to the support arms.

Other objects and advantages will become apparent from the following description and the drawings.

DETAILED DESCRIPTION

Figure 2:
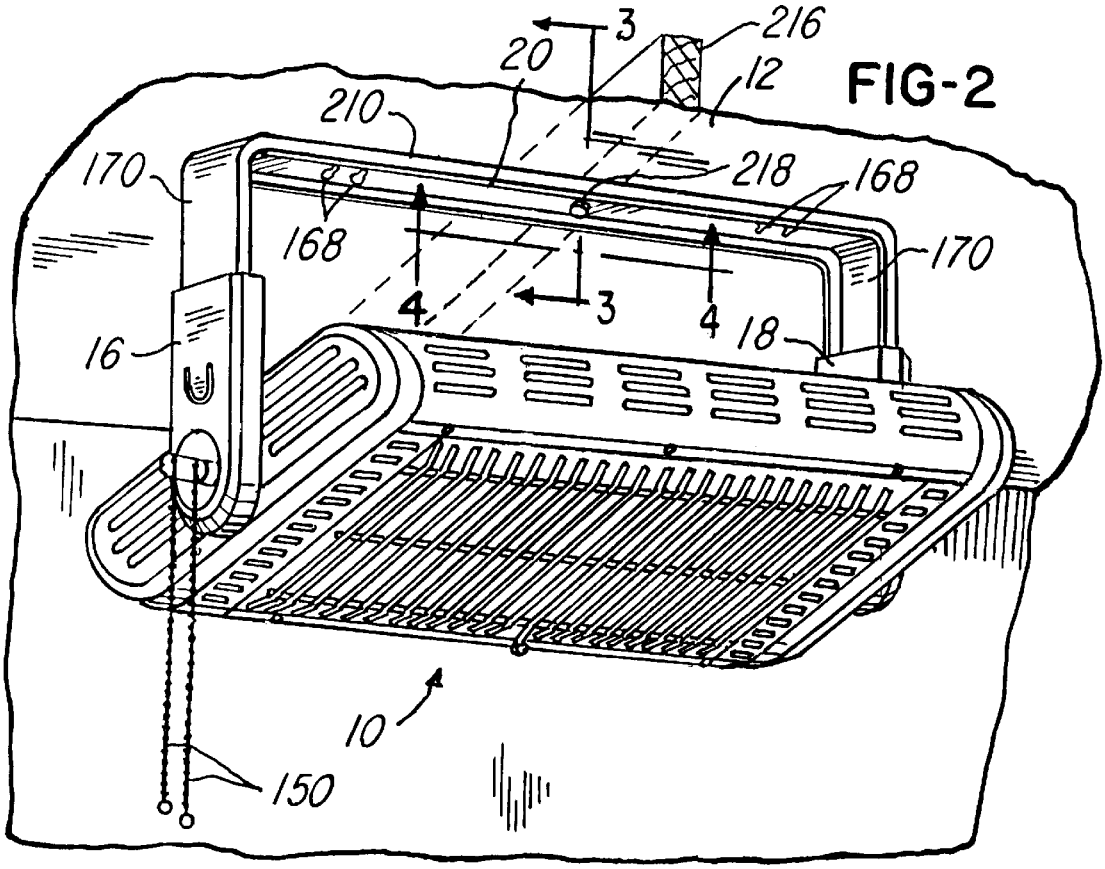
FIG. 2 is a fragmentary perspective view showing a heater mounted to a ceiling using the swivel mounting arrangement illustrated in FIG. 1.

FIG. 2 shows a heater 10 comprising a heater housing 14 and a support bracket 20 to which the heater housing 14 is mounted for pivotal movement about a horizontal axis. The heater 10 may be identical to the heater disclosed in the above-mentioned U.S. Pat. No. 5,621,846 except that the support bracket 20 of the present invention has a centrally located aperture 212 which is used with a single wood bolt 218 to secure the mounting bracket 20 to the ceiling for swiveling movement about the axis of the wood bolt 218. The hole 20 is preferably provided in addition to the plural key hole slots 168 of U.S. Pat. No. 5,621,846.

Figure 1:
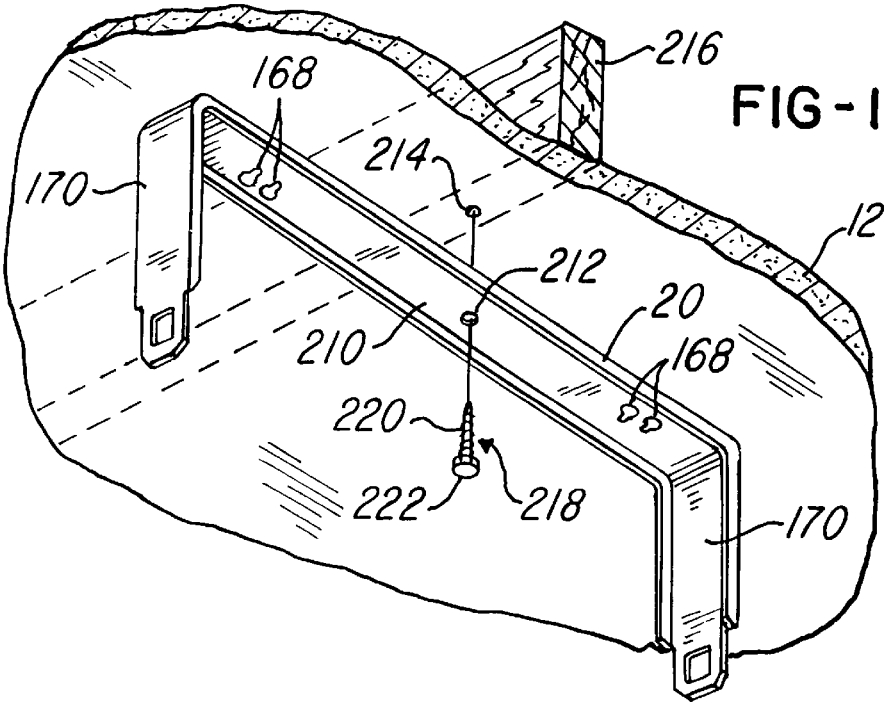
FIG. 1 is a fragmentary, exploded perspective view of a swivel mounting arrangement for a heater in accordance with this invention.
Figure 3:
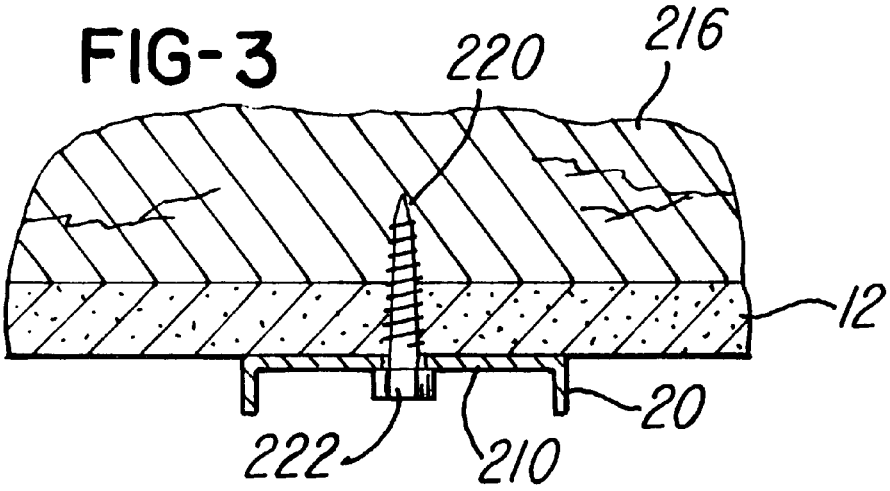
FIG. 3 is a fragmentary cross-sectional view taken along lines 3—3 of FIG. 2.

With reference particularly to FIG. 1, the aperture 212 is provided in the support member 210 centrally between the support arms 170. The aperture 212 is aligned with a pilot hole 214 formed as by drilling, in the ceiling 12 and in a joist 216, which joist supports the ceiling 12. A conventional, commercially-available hex-head wood bolt 218 is screwed into the pilot hole 214, as best shown FIG. 3, so that the shaft 220 of the wood bolt 218 extends into the ceiling 12, which may be drywall for example, and further into the ceiling joist 216. The support member 210 is thus trapped between the ceiling 12 and the head 222 of the bolt 218 to secure the mounting bracket 20, and thereby the heater 10, to the ceiling 12. If desired, a suitable washer (not shown) can be provided between the head 222 of the bolt 218 and the underneath side of the support member 210 to provide a bearing surface other than the head 222 of the bolt 218 to support the heater 10.

Figure 4:
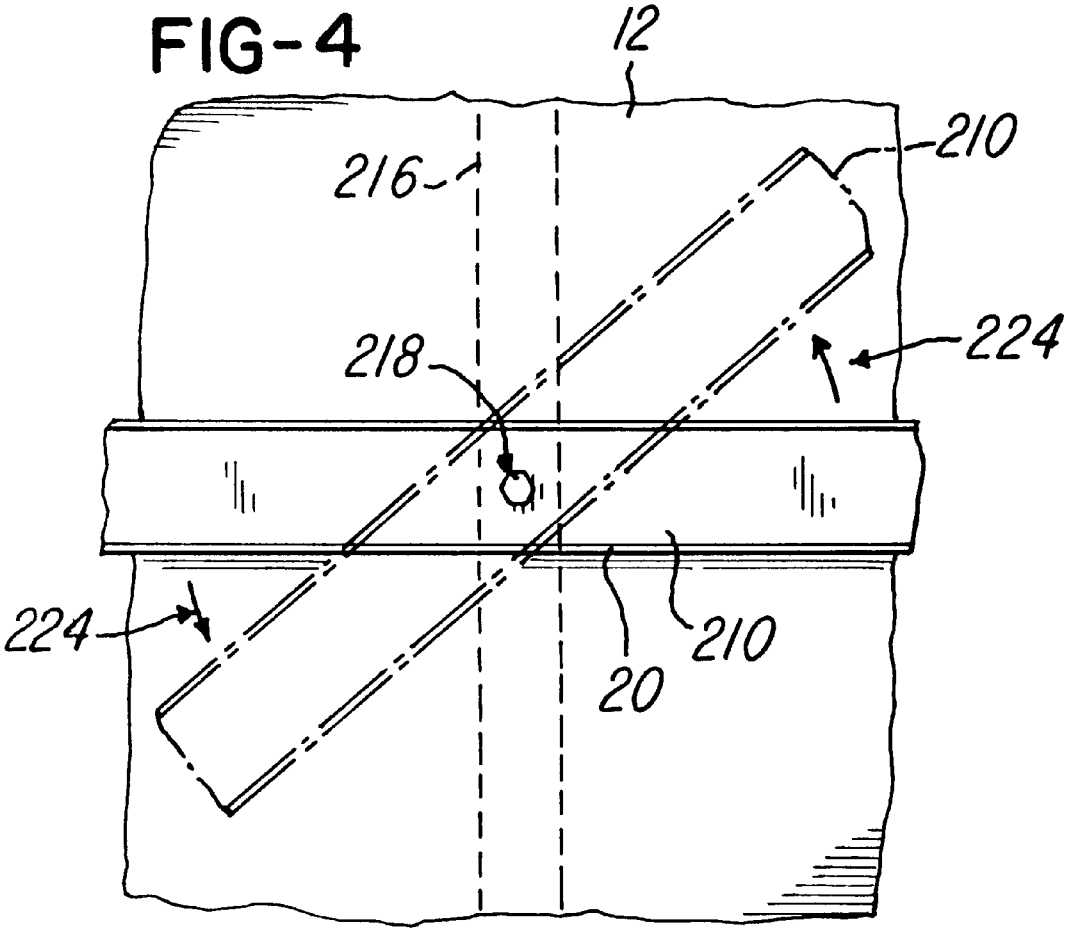
FIG. 4 is a fragmentary plan view taken along lines 4—4 of FIG. 2.

As indicated by the arrows 224 in FIG. 4, the heater 10 can be swiveled 360 degrees about a vertical axis defined by the wood bolt 218 to direct heat energy from the heater to any desired area of the surrounding workspace. In addition, the heater 14 is pivotal about a horizontal axis, which provides additional adjustment in the direction of heat energy from the heater 10. It will be understood that the swivel mounting arrangement illustrated is FIGS. 1 through 4 is useful not only with radiant electric heaters, but also with convection heaters.

Although the presently preferred embodiments of this invention have been described, it will be understood that within the purview of the invention various changes may be made within the scope of the following claims.

Having thus described my invention, I claim:

1. A ceiling-mounted electric heater, comprising:

a housing having a heating element mounted therein;

a U-shaped support bracket having mutually-spaced, downwardly-depending support arms joined by a horizontally-extending support member, each of said arms being connected to said housing, said support member having an aperture extending therethrough intermediate said support arms; and a swivel mounting member comprising a shaft extending through the aperture in said support member and into the ceiling, said shaft defining a vertical axis about which said heater can be swiveled, said swivel mounting member having an enlarged portion engaging the underneath side of said support member, whereby said heater is swivelably secured to the ceiling.

2. The heater of claim 1 wherein said swivel mounting member comprises a wood bolt.

3. The heater of claim 1 wherein said housing is pivotally connected to the support arms such that said housing is pivotal about a horizontal axis.

4. The heater of claim 1 wherein said heater is a radiant heater and wherein said housing also has a reflector assembly mounted therein.

5. The heater of claim 1 wherein the aperture in said support member is located centrally intermediate said support arms.

6. In a ceiling-mounted electric heater comprising a heater housing and a U-shaped support bracket having mutually-spaced, downwardly-depending support arms joined by a horizontally-extending support member, said support arms being connected to said heater housing and said support member being mounted to a ceiling, the improvement wherein said support member is constructed to be swivelably mounted to the ceiling about a vertical axis.

7. The improvement of claim 6 further wherein said support member is provided with an aperture therethrough intermediate said support arms, and wherein said support member is secured to the ceiling by a wood bolt extending through said aperture and into the ceiling.

8. The improvement of claim 6 wherein said heater is a radiant electric heater.

9. A method for mounting an electric heater to a ceiling, said heater comprising a heater housing and a U-shaped support bracket having mutually-spaced, downwardly-depending support arms joined by a horizontally-extending support member, said support arms being connected to said heater housing, comprising the steps of:

providing an aperture through said support member intermediate said support arms;

positioning said support member against the ceiling; and advancing a bolt through the aperture in said support member and into the ceiling, whereby said heater is mounted to the ceiling and can be swiveled about a vertical axis defined by said bolt to direct heat energy from said heater in a desired direction.

10. The method of claim 9 further comprising the step of:

before said positioning step, providing a pilot hole in the ceiling, and wherein said positioning step comprises positioning said support member with the aperture in said support member aligned with said pilot hole.

11. The method of claim 9 wherein said aperture is provided in said support member centrally intermediate said support arms.

12. The heater of claim 1 wherein said support member further has at least two keyhole slots, at least one of said keyhole slots located between said aperture and one of said arms and at least another of said keyhole slots located between said aperture and the other of said arms, and wherein said heater can be non-rotably mounted to said ceiling by bolts received by said keyhole slots.

13. The improvement of claim 6 wherein said heater is pivotally mounted on said support arms for rotation about a horizontal axis.

* * * * *